US007238923B2

(12) United States Patent
Kim et al.

(10) Patent No.: US 7,238,923 B2
(45) Date of Patent: Jul. 3, 2007

(54) COOKING APPARATUS HAVING A BAR CODE READER AND A COOKING METHOD OF THE SAME

(75) Inventors: Kwang Keun Kim, Seoul (KR); Seok Weon Hong, Yongin (KR); Yu Jeub Ha, Suwon-Si (KR); Hyun Suk Kim, Yongin (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 60 days.

(21) Appl. No.: 11/139,973

(22) Filed: May 31, 2005

(65) Prior Publication Data

US 2006/0027568 A1 Feb. 9, 2006

(30) Foreign Application Priority Data

Aug. 4, 2004 (KR) ..... 10-2004-0061502

(51) Int. Cl.
*H05B 1/02* (2006.01)

(52) U.S. Cl. ..... 219/518; 219/506; 219/492; 219/708; 219/483; 99/326

(58) Field of Classification Search ..... 219/483–486, 219/508, 518, 497, 411–414, 708, 506; 99/325–331
See application file for complete search history.

(56) References Cited

U.S. PATENT DOCUMENTS

| | | | | |
|---|---|---|---|---|
| 5,938,966 | A * | 8/1999 | Oh et al. | 219/702 |
| 6,862,494 | B2 * | 3/2005 | Hu et al. | 700/211 |
| 2006/0036395 | A1 * | 2/2006 | Shaya et al. | 702/127 |

* cited by examiner

*Primary Examiner*—Mark Paschall
(74) *Attorney, Agent, or Firm*—Staas & Halsey LLP

(57) ABSTRACT

A cooking apparatus and method thereof capable of performing a cooking process based upon a cooking condition corresponding to the amount of food introduced into a cooking chamber when the cooking process is performed using a bar code printed on a food package to be cooked. The cooking method includes reading a bar code storing a reference weight of food to be cooked and a cooking condition based on the reference weight, sensing the weight of food introduced into a cooking chamber, calculating a number of servings of the food introduced into the cooking chamber by using the weight of the food introduced into the cooking chamber and the reference weight of the food, and changing the cooking condition to correspond to the number of servings of the food introduced into the cooking chamber, when the number of servings of the food introduced into the cooking chamber varies from a number of servings corresponding to the reference weight of the food, to thereby set a final cooking condition is corresponding to the changed cooking condition.

23 Claims, 10 Drawing Sheets

COOKING APPARATUS HAVING A BAR CODE READER AND A COOKING METHOD OF THE SAME

CROSS-REFERENCE TO RELATED APPLICATIONS

This application claims the benefit of Korean Patent Application No. 2004-61502, filed on Aug. 4, 2004 in the Korean Intellectual Property Office, the disclosure of which is incorporated herein by reference.

BACKGROUND OF THE INVENTION

1. Field of the Invention

The present invention relates to a cooking apparatus and a cooking method thereof, and, more particularly, to a cooking apparatus and a cooking method thereof capable of reading a bar code attached to a food package, thereby conveniently cooking the food.

2. Description of the Related Art

Generally, cooking apparatuses are devices that cook foods using various heating sources. The cooking apparatuses are classified into several types of cooking apparatuses. For example, a microwave oven is a cooking apparatus that cooks foods using microwaves. In the conventional microwave oven, a user directly inputs cooking time, cooking mode, and kinds of food to be cooked through the use of a key input unit formed at the front panel of the microwave oven: That is, in the conventional microwave oven it is necessary that the user manually input cooking information. Consequently, appropriate cooking conditions are not easily and conveniently set.

In order to solve the above-mentioned problem, a microwave oven having a bar-code reader has been developed that is capable of cooking foods based upon the cooking information read by the bar-code reader. Such a microwave oven is disclosed in Korean Unexamined Patent Publication No. 2001-0010530 and Korean Unexamined Patent Publication No. 1999-0074607.

The conventional microwave oven having the bar-code reader includes a cooking chamber disposed in an oven body, a built-in bar-code reader disposed at the front panel of the oven body or a charge-coupled display-type or pen-type bar-code reader that is connected to the oven body via a cable, a display unit which displays the operation of the microwave oven, an input unit including a plurality of input buttons, and a magnetron which generates microwaves to be supplied to the cooking chamber.

To perform a cooking process in the conventional microwave oven having the bar-code reader as described above, a user brings a bar code attached to a food package to the bar-code reader to read the bar code, and the microwave oven performs the cooking process on based upon the cooking condition stored in the read bar code.

In the conventional microwave oven having the bar-code reader, however, the cooking process is performed only based upon the cooking condition read from the bar code without consideration of the amount of food to be cooked. As a result, the food may be insufficiently or excessively cooked. For example, when a portion of a three-serving food package is cooked in the cooking chamber in accordance with cooking conditions stored in a bar code printed on the three-serving food package, which are set to cook the entire three-serving food package, the food is excessively cooked.

On the other hand, when the entire three-serving food package is cooked in the cooking chamber based upon a cooking condition stored in the bar code printed on the three-serving food package, which are set to cook a one-serving portion of the three-serving food package, the food is insufficiently cooked.

SUMMARY OF THE INVENTION

Accordingly, it is an aspect of the present invention to provide a cooking apparatus and a cooking method thereof capable of performing a cooking process in accordance with a cooking condition corresponding to an amount of food introduced into a cooking chamber when the cooking process is performed using a bar code printed on a food package.

Additional aspects and/or advantages of the invention will be set forth in part in the description which follows and, in part, will be apparent from the description, or may be learned by practice of the invention.

The foregoing and/or other aspects of the present invention are achieved by providing a cooking method for performing a cooking process using a bar code, the method including reading a bar code storing a reference weight of food to be cooked and a cooking condition based on the reference weight, measuring a weight of the food introduced into a cooking chamber, calculating a number of servings of the food introduced into the cooking chamber by using the weight of the food introduced into the cooking chamber and the reference weight of the food and changing the cooking condition to correspond to the number of servings of the food introduced into the cooking chamber, when the number of servings of the food introduced into the cooking chamber varies from a number of servings corresponding to the reference weight of the food, thereby setting a final cooking condition corresponding to the changed cooking condition .

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
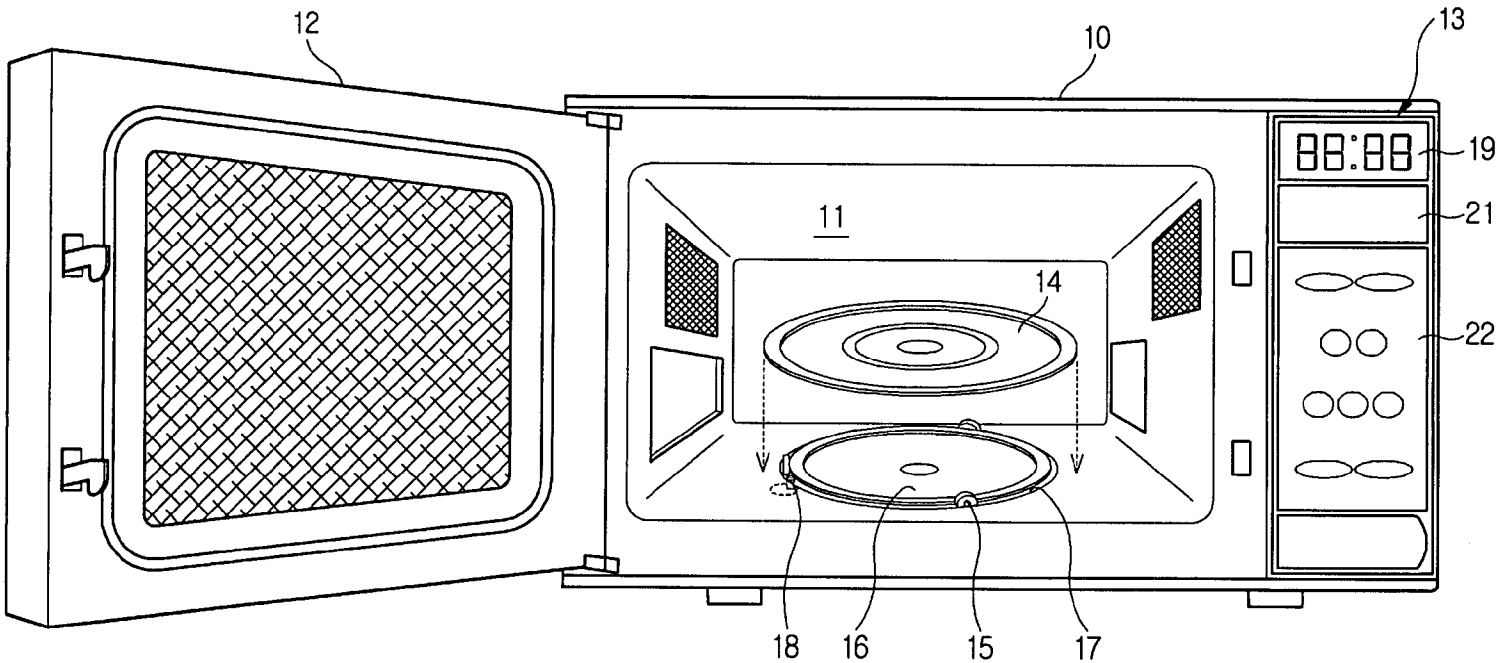
FIG. 1 is a front view illustrating a cooking apparatus, such as a microwave oven, capable of performing a cooking method in accordance with an embodiment of the present invention.

Reference will now be made in detail to the embodiment of the present invention, examples of which are illustrated in the accompanying drawings, wherein like reference numerals refer to like elements throughout. The embodiment is described below to explain the present invention by referring to the figures.

In FIG. 1, a microwave oven according to the present invention comprises a cooking chamber 11 disposed in an oven body 10 a door 12 to open/close an opening of the cooking chamber 11, and a front panel 13 disposed at the right side of the door 12.

A tray 14 is disposed at a bottom of the cooking chamber 11, to be rotated with food placed thereon. At the central lower part of the tray 14 is mounted a tray motor 25 (See FIG. 2) to rotate the tray 14. Around the lower circumference of the tray 14 is disposed a ring-shaped roller supporting member 16 including a plurality of rollers 15. The rollers 15 are moved along a circular track 17. At the lower surface of the track 17 is disposed a weight sensor 18 to sense the weight of the food to be cooked placed on the tray 14. As the tray motor 25 is operated, the tray is rotated while the plurality of rollers 15 roll along the track 17. When the rollers 15 pass over the weight sensor 18, the rollers 15 press against the weight sensor 18 so that the weight of the food to be cooked, which is placed on the tray 14, can be measured by the weight sensor 18.

The front panel 13 comprises a display unit 19 disposed at the upper part thereof to display an operation of the microwave oven, a built-in bar-code reader 21 disposed below the display unit 19 to read a bar code, and an input unit 22 including a plurality of input buttons is disposed below the bar-code reader 21.

Figure 2:
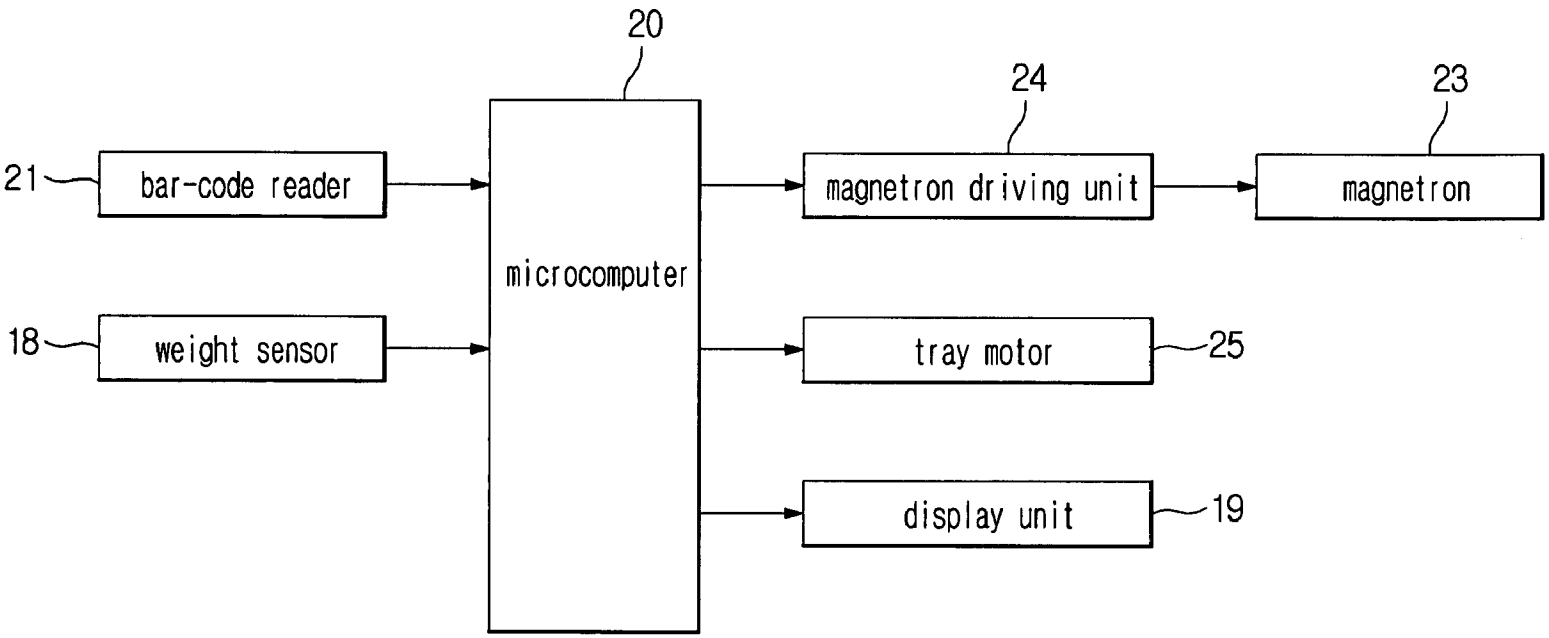
FIG. 2 is a block diagram illustrating the microwave oven shown in FIG. 1.

In FIG. 2, the microwave oven further comprises a magnetron-driving unit 24 to drive a magnetron 23 that generates microwaves to be supplied to the cooking chamber 11, a tray motor 25 to rotate the tray 14, and a microcomputer 20 to interpret the bar code read by the bar-code reader 21 and control the respective components of the microwave oven.

Figure 3:
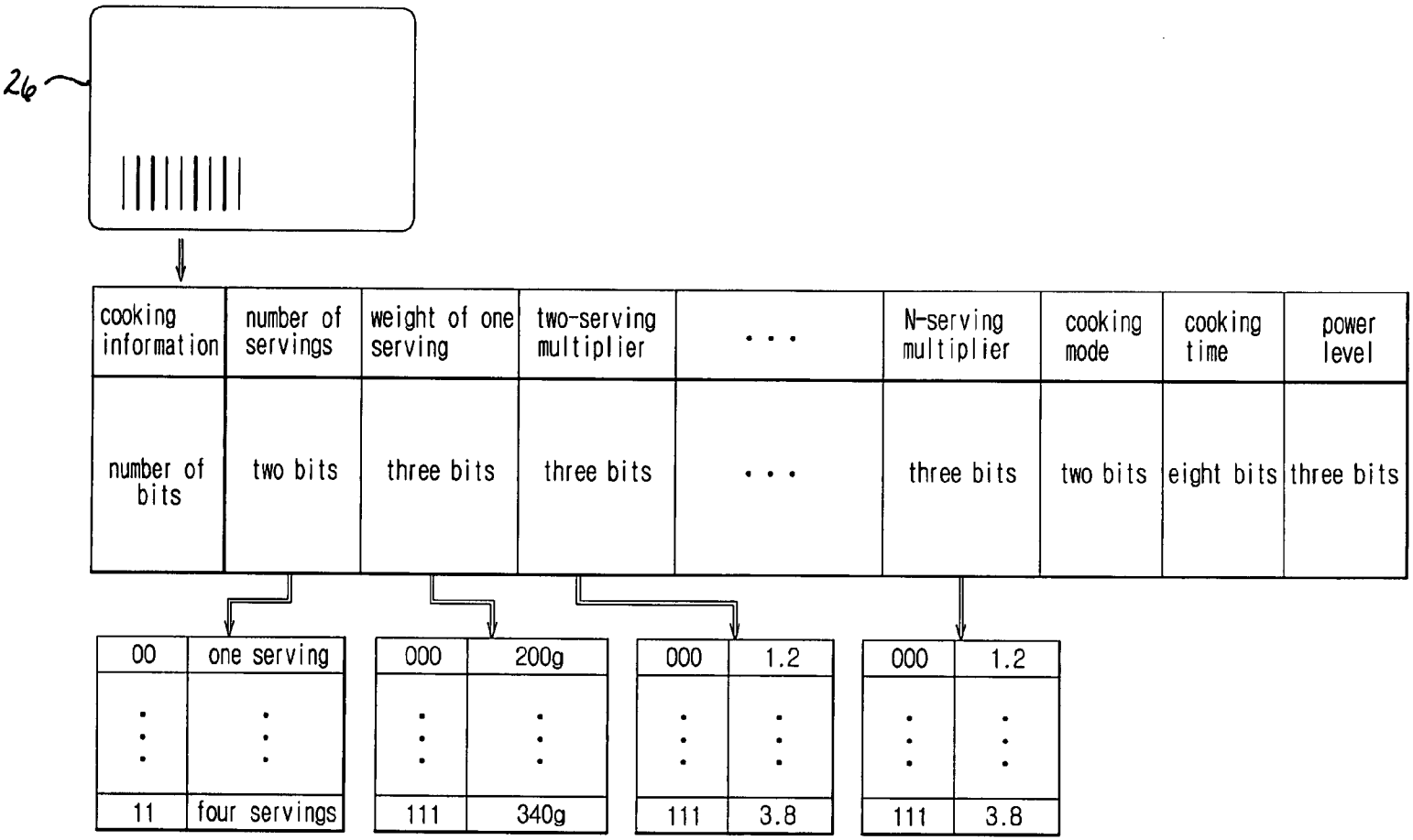
FIG. 3 is a view illustrating cooking information stored in a bar code used in the microwave oven shown in FIG. 1.

An embodiment of the present invention will be described with reference to FIGS. 3 and 4. In FIG. 3, a bar code 26 stores cooking information containing number of servings, serving multipliers, the weight of one serving, and various cooking conditions. Also, the microcomputer 20 stores interpreting rules as is indicated in FIG. 3. Specifically, the interpreting rules stored in the microcomputer 20 prescribe what cooking information each line stores, and detailed contents of the cooking information corresponding to a value of the read bar code 26.

TABLE 1

| Number of bits | Two bits | | Three bits | |
|---|---|---|---|---|
| Cooking information | Number of servings | | N-serving multiplier | |
| Cooking contents | 00 | One serving | 000 | 1.2 |
| | . . . | | . . . | |
| | 11 | Four servings | 111 | 2.6 |

In Table 1 above, the number of servings indicates the number of servings of food to be cooked. The number of servings stored in the bar code 26 is the total number of servings of the food package. Two bits are assigned to the bar code 26 set to store the number of servings. For example, when the read bar code 26 is "00," the number of servings of the food to be cooked corresponds to one serving. When the read bar code 26 is "11," the number of servings of the food to be cooked corresponds to four servings.

For example, the serving multiplier may be used to properly change the cooking time stored in the bar code 26, which is set to appropriately cook one serving of the food, when the number of servings is greater than one serving. When the cooking condition is cooking time, the serving multiplier determines a value by which the cooking time for one serving is multiplied when multiple servings are to be cooked. The cooking time for multiple servings is calculated by the following equation.

Cooking time for N servings=cooking time for one serving*N-serving multiplier where, N is a natural number greater than 1, and N servings is the number of servings of the food introduced into the cooking chamber.

For example, when the cooking time for one serving is set to 200 seconds, the two-serving multiplier is set to 1.2, and the three-serving multiplier is set to 1.4, the cooking time for two servings is 240 seconds (200*1.2), and the cooking time for three servings is 280 seconds (200*1.4). Consequently, the cooking time for N servings is the product of the cooking time for one serving and the N-serving multiplier.

The bar code 26 stores serving multipliers corresponding to the respective servings (excluding one serving) less than or equal to the total servings of the food package to be cooked as shown in FIG. 3. For example, when a food package to be cooked is a three-serving food package, a two-serving multiplier corresponding to two servings and a three-serving multiplier corresponding to three servings are stored in sequence in the bar code 26. The value of the serving multiplier may be experimentally selected. When the number of servings of the food to be cooked is more than one, the cooking time for one serving (i.e., the cooking time read from the bar code 26) is multiplied by the serving multiplier corresponding to the number of servings by means of the microcomputer 20 (shown in FIG. 2). As a result, the cooking time for the number of servings is calculated.

The weight of one serving is the weight of the food to be cooked corresponding to one serving. Three bits are assigned to the bar code 26 for storing the weight of one serving. For example, when the read bar code 26 is "000," the weight of the food to be cooked is 200 grams. When the read bar code 26 is "111," the weight of the food to be cooked is 340 grams.

The cooking information stored in the bar code 26 further comprises various cooking conditions including cooking mode and cooking time, in addition to the number of servings, the serving multipliers, and the weight of one serving. Specifically, the cooking time is set to appropriately cook one serving of food.

The operation of the first embodiment of the present invention will now be described with reference to FIG. 4.

Figure 4:
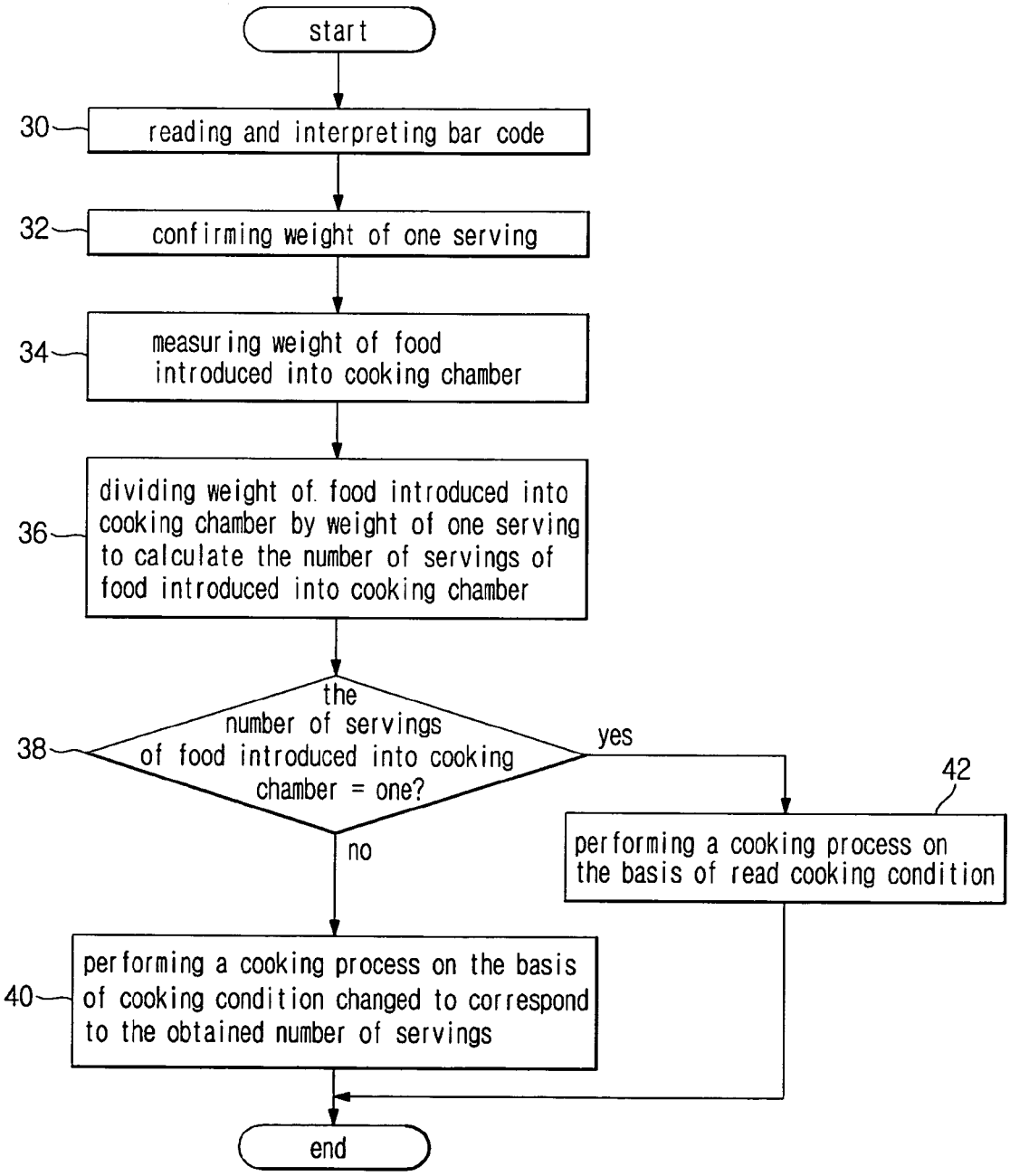
FIG. 4 is a flowchart illustrating an operation of the microwave oven shown in FIGS. 1 and 2 in accordance with an embodiment of the present invention.

In FIG. 4, in operation 30, when a user brings a bar code 26 printed on a food package to be cooked to the bar-code reader 21, the bar-code reader 21 reads the bar code. When the bar code 26 is read by the bar-code reader 21, the read bar code is transmitted to the microcomputer 20. The microcomputer 20 interprets the cooking information stored in the bar code 26 using the interpreting rules stored in the microcomputer 20.

From operation 30, the process moves to operation 32, where when the cooking information is interpreted, the microcomputer 20 confirms the weight of one serving of food contained in the cooking information.

From operation 32, the process moves to operation 34, where the weight of the food introduced into the cooking chamber 11 by the user is confirmed based upon the weight measured by the weight sensor 18, which is obtained as the tray motor 25 is operated. The weight measured by the weight sensor 18 is a sum of the weight of the tray 14 and the weight of the food to be cooked. The microcomputer 20 calculates a net weight of the food introduced into the cooking chamber by subtracting the weight of the tray 14 from the weight measured by the weight sensor 18. The weight of the tray 14 is previously stored in the microcomputer 20.

From operation 34, the process moves to operation 36, where when the weight of one serving and the weight of the food introduced into the cooking chamber 11 are obtained, the weight of the food introduced into the cooking chamber 11 is divided by the weight of one serving to calculate the number of servings of the food introduced into the cooking chamber 11. For example, when the weight of one serving is 200 grams and the weight of the food introduced into the cooking chamber 11 is 400 grams, the number of servings of the food introduced into the cooking chamber 11 is two servings (400 grams/200 grams).

From operation 36, the process moves to operation 38, where the microcomputer 20 determines whether the number of servings of the food introduced into the cooking chamber 11 is equal to one serving. When it is determined in operation 38 that the number of servings of the food introduced into the cooking chamber 11 is one serving, the process moves to operation 42, where the cooking process is performed using the cooking time stored in the bar code 26.

Alternatively, when it is determined in operation 38 that the number of servings of the food introduced into the cooking chamber 11 is two or more servings, the process moves to operation 40, where the microcomputer 20 changes the cooking time (i.e., multiplies the cooking time by the serving multiplier corresponding to the number of servings of the food introduced into the cooking chamber 11), and performs the cooking process using the changed cooking time. For example, when the food introduced into the cooking chamber 11 corresponds to two servings, the cooking time is 50 seconds, and the two-serving multiplier is 1.2, the cooking time is changed to 60 seconds (50*1.2). As the cooking time is changed, the microcomputer 20 drives the magnetron 23 for the period of the changed cooking time to perform the cooking process. As a result, the food introduced into the cooking chamber is optimally cooked.

A second embodiment of the present invention will now be described with reference to FIGS. 5 and 6. The second embodiment is different from the first embodiment in that the cooking time stored in the bar code 26*a* is set to appropriately cook the entire food package.

TABLE 2

| Number of bits | Two bits | | Three bits | |
|---|---|---|---|---|
| Cooking information | Number of servings | | N-serving multiplier | |
| Cooking contents | 00 | One serving | 000 | 0.2 |
| | . . . | | . . . | |
| | 11 | Four servings | 111 | 0.9 |

For example, the serving multiplier used in the second embodiment is provided for properly changing a cooking condition stored in the bar code 26*a* according to a decrease of the number of servings when a user cooks less food than the total number of servings as in indicated in Table 2. That is, when the cooking condition is cooking time, the serving multiplier determines a value by which the cooking time for the total number of servings to be multiplied by when less than the total number of servings is to be cooked. Consequently, when the total number of servings is different from the number of servings of the food introduced into the cooking chamber, the cooking time is calculated by the following equation.

Cooking time for *N* servings=cooking time for the total number of servings**N*-serving multiplier where, *N* is a natural number, and *N* servings is the number of servings of the food introduced into the cooking chamber, which is less than the total number of servings.

For example, when the total number of servings is two servings, the cooking time for two servings is 200 seconds, the one-serving multiplier corresponding to one serving is 0.7, and the food to be cooked corresponds to one servings, the cooking time is changed to 140 seconds (200*0.7). Consequently, the cooking time for N servings is the product of the cooking time for the total number of servings and the N-serving multiplier.

Figure 5:
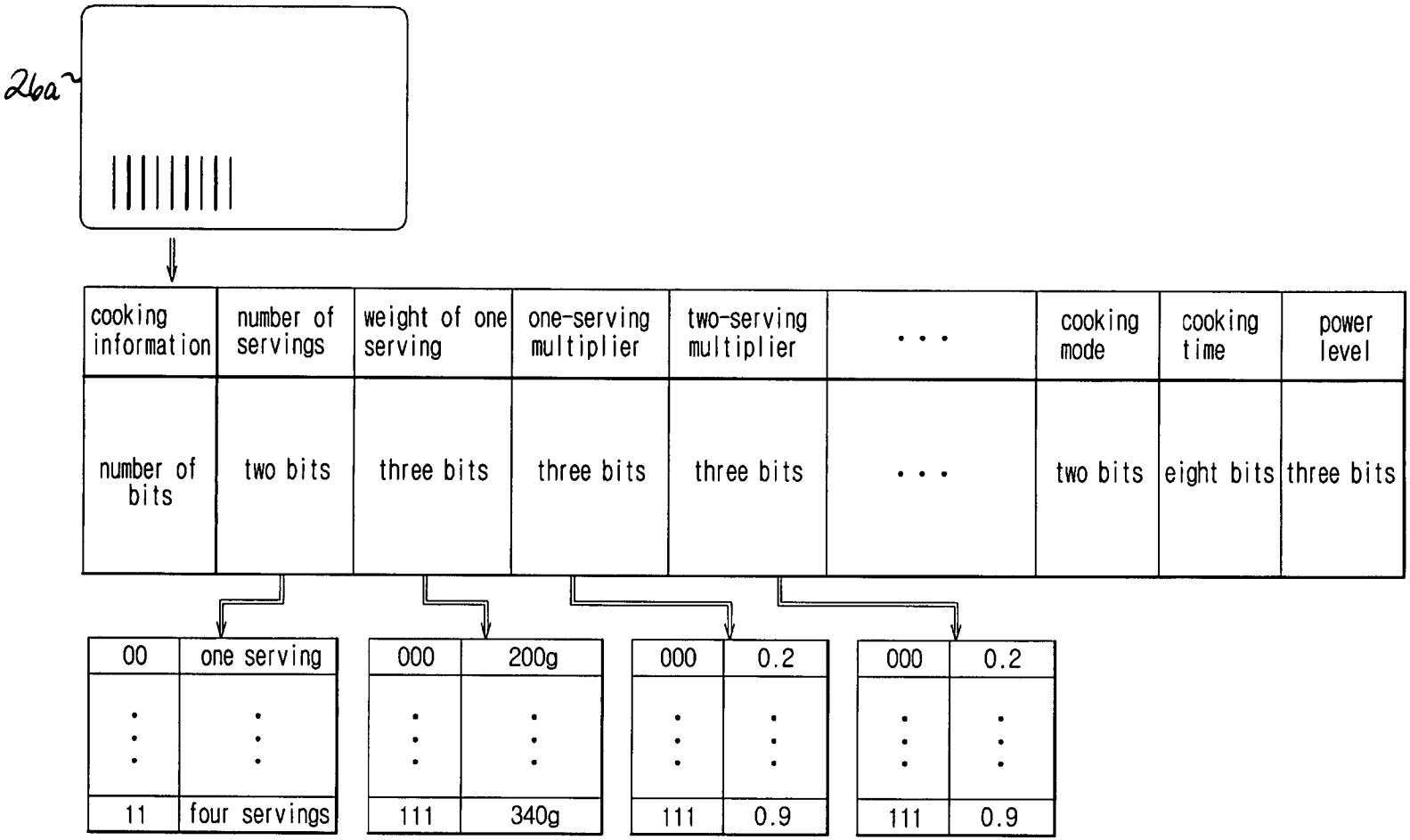
FIG. 5 is a view illustrating cooking information stored in a bar code used in a second embodiment of the present invention.

In FIG. 5, the bar code 26*a* stores serving multipliers corresponding to the number of servings less than the total number of servings of the food package to be cooked. For example, when a food package to be cooked is a three-serving food package, a one-serving multiplier corresponding to one serving and a two-serving multiplier corresponding to two servings are stored in sequence in the bar code 26*a*. The value of the serving multiplier may be experimentally selected. When the number of servings of the food to be cooked is less than the total number of servings, the cooking time for the total number of servings (i.e., the cooking time read from the bar code 26*a*) is multiplied by the serving multiplier corresponding to the number of servings by means of the microcomputer 20. As a result, a cooking time for the number of servings is calculated. The other cooking information shown in FIG. 5 is identical to that of FIG. 3, a description will not be given accordingly.

The operation of the second embodiment of the present invention will now be described with reference to FIG. 6. Operations 50 to 56 of FIG. 6 are identical to Operations 30 to 36 of FIG. 4, a description will not be given accordingly.

Figure 6:
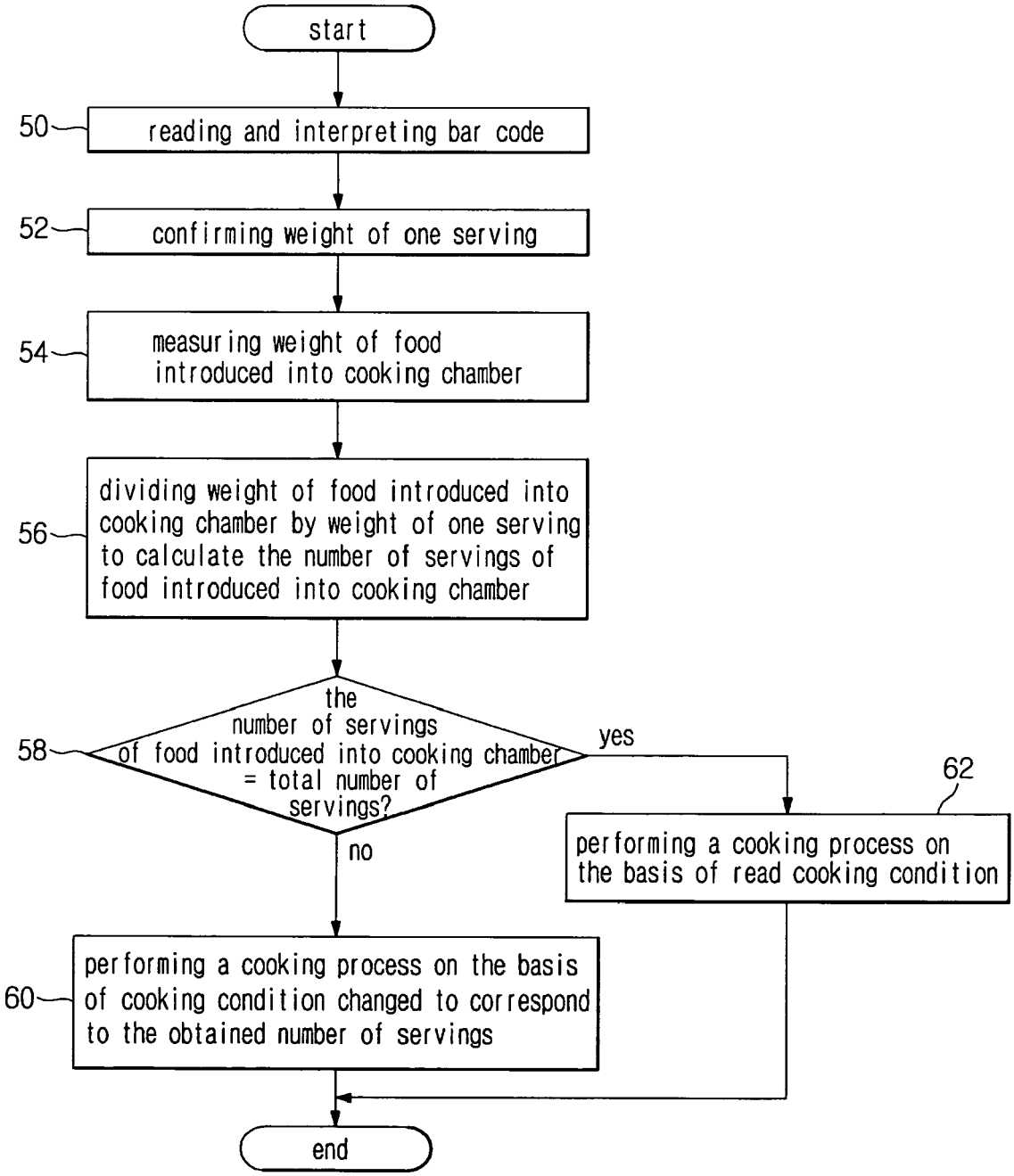
FIG. 6 is a flowchart illustrating an operation of the microwave oven shown in FIGS. 1 and 2 according to the second embodiment of the present invention.

In FIG. 6, from operation 56, the process moves to operation 58, where the microcomputer 20 determines whether the number of servings of the food introduced into the cooking chamber 11 is equal to the total number of servings. When it is determined in operation 58 that the food introduced into the cooking chamber 11 corresponds to the total number of servings, the process moves to operation 62, where the cooking process is performed for the cooking time stored in the bar code 26*a*.

When it is determined in operation 58 that the number of servings of the food introduced into the cooking chamber 11 is less than the total number of servings, the process moves to operation 60, where the microcomputer 20 changes the cooking time(i.e., multiplies the cooking time by the serving multiplier corresponding to the number of servings of the food introduced into the cooking chamber 11), and performs the cooking process using the changed cooking time. For example, when a food package to be cooked corresponds to three servings, and the food introduced into the chamber 11 corresponds to two servings, the cooking time is 200 seconds, and the two-serving multiplier is 0.7, the cooking time is changed to 140 seconds (200*0.7). When the cooking time is changed, the microcomputer 20 drives the magnetron 23 for the period of the changed cooking time to perform the cooking process. As a result, the food introduced into the cooking chamber is optimally cooked.

Figure 7:
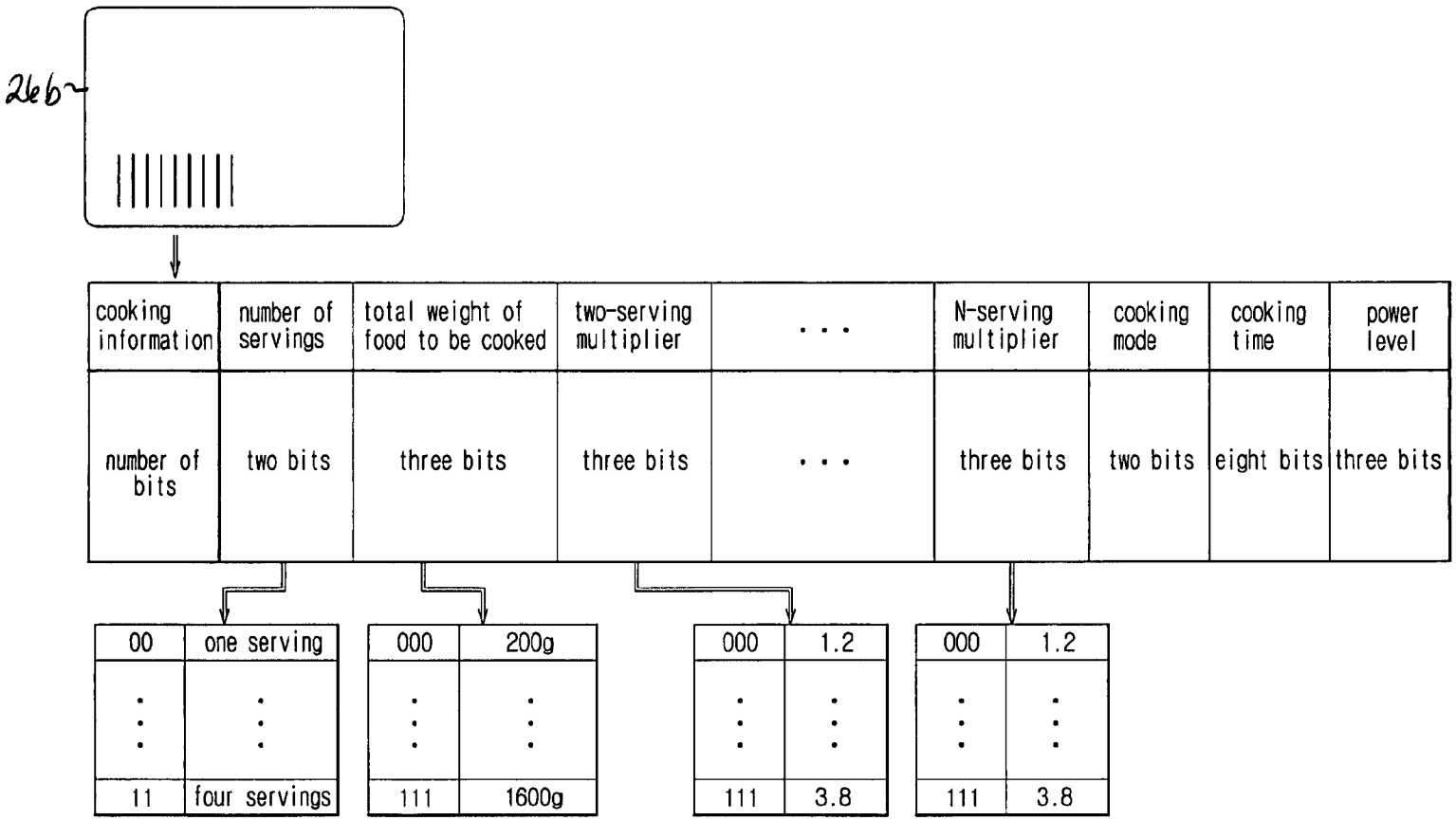
FIG. 7 is a view illustrating cooking information stored in a bar code used in a third embodiment of the present invention.

The third embodiment of the present invention will now be described with reference to FIGS. 7 and 8. In FIG. 7, a bar code 26*b* used in the third embodiment stores the total weight of the food instead of the weight of one serving of food, and the cooking time is set to appropriately cook one serving.

The total weight of the food to be cooked is the total weight of the food package. The total weight of the food to be cooked is previously measured and stored in the bar code 26*b*. Three bits are assigned to the bar code for storing the weight of the total number of servings of the food to be cooked. When the read bar code 26*b* is "000," the total weight of the food to be cooked is 200 grams. When the read bar code 26*b* is "111," the total weight of the food to be cooked is 1600 grams. The additional cooking information of FIG. 7 is identical to that of FIG. 3, the description of which will not be given accordingly.

An operation of the third embodiment of the present invention will now be described with reference to FIG. 8. In FIG. 8, in operation 70, when a user brings a bar code 26*b* printed on a food package to be cooked to the bar-code reader 21, the bar-code reader 21 reads the bar code 26*b*. When the bar code 26*b* is read by the bar-code reader 21, the read bar code 26*b* is transmitted to the microcomputer 20. The microcomputer 20 interprets the cooking information stored in the bar code 26*b* using the interpreting rules stored in the microcomputer 20. From operation 70, the process moves to operation 72, where, when the cooking information is interpreted, the microcomputer 20 confirms the number of servings of the food package to be cooked and the weight of the food package to be cooked based upon the total number of servings and the total weight of the food contained in the cooking information. From operation 72, the process moves to operation 74, where the total weight of the food to be cooked is divided by the total number of servings, to thereby calculate the weight of the food to be cooked corresponding to one serving.

From operation 74 the process moves to operation 76, where the weight of the food introduced into the cooking chamber 11 by the user is confirmed based upon the weight measured by the weight sensor 18, which is obtained as the tray motor 25 is operated. The weight measured by the weight sensor 18 is the sum of the weight of the tray 14 and the weight of the food to be cooked. The microcomputer 20 calculates the net weight of the food introduced into the cooking chamber by subtracting the weight of the tray 14 from the weight measured by the weight sensor 18. The weight of the tray 14 is previously stored in the microcomputer 20.

From operation 76, the process moves to operation 78, where when the weight of the food to be cooked corresponding to one serving and the weight of the food introduced into the cooking chamber 11 are obtained, the weight of the food introduced into the cooking chamber 11 is divided by the weight of the food to be cooked corresponding to one serving to calculate the number of servings of the food introduced into the cooking chamber 11. For example, when the food package to be cooked is a three-serving food package (total number of servings) and the weight of the food package is 600 grams (i.e., total weight of the food to be cooked), the weight of the food to be cooked corresponding to one serving is 200 grams (600 grams/3). When the food introduced into the cooking chamber 11 is 400 grams, the number of servings of the food introduced into the cooking chamber 11 is two servings (400 grams/200 grams).

Figure 8:
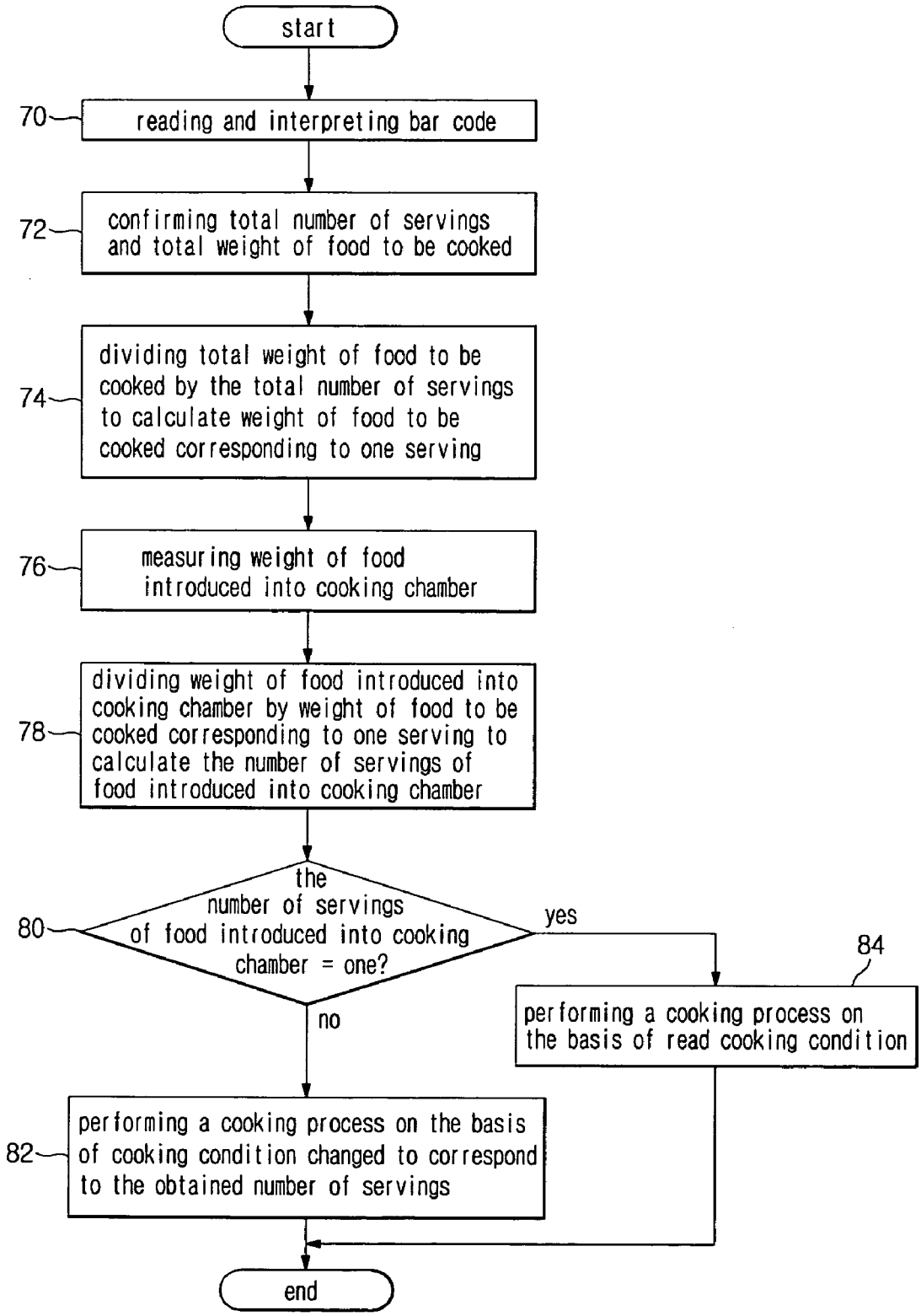
FIG. 8 is a flowchart illustrating an operation of the microwave oven shown in FIGS. 1 and 2 according to the third embodiment of the present invention.

Operations 80 to 84 of FIG. 8 are identical to Operations 38 to 42 of FIG. 4, the description of which will not be given accordingly.

Figure 9:
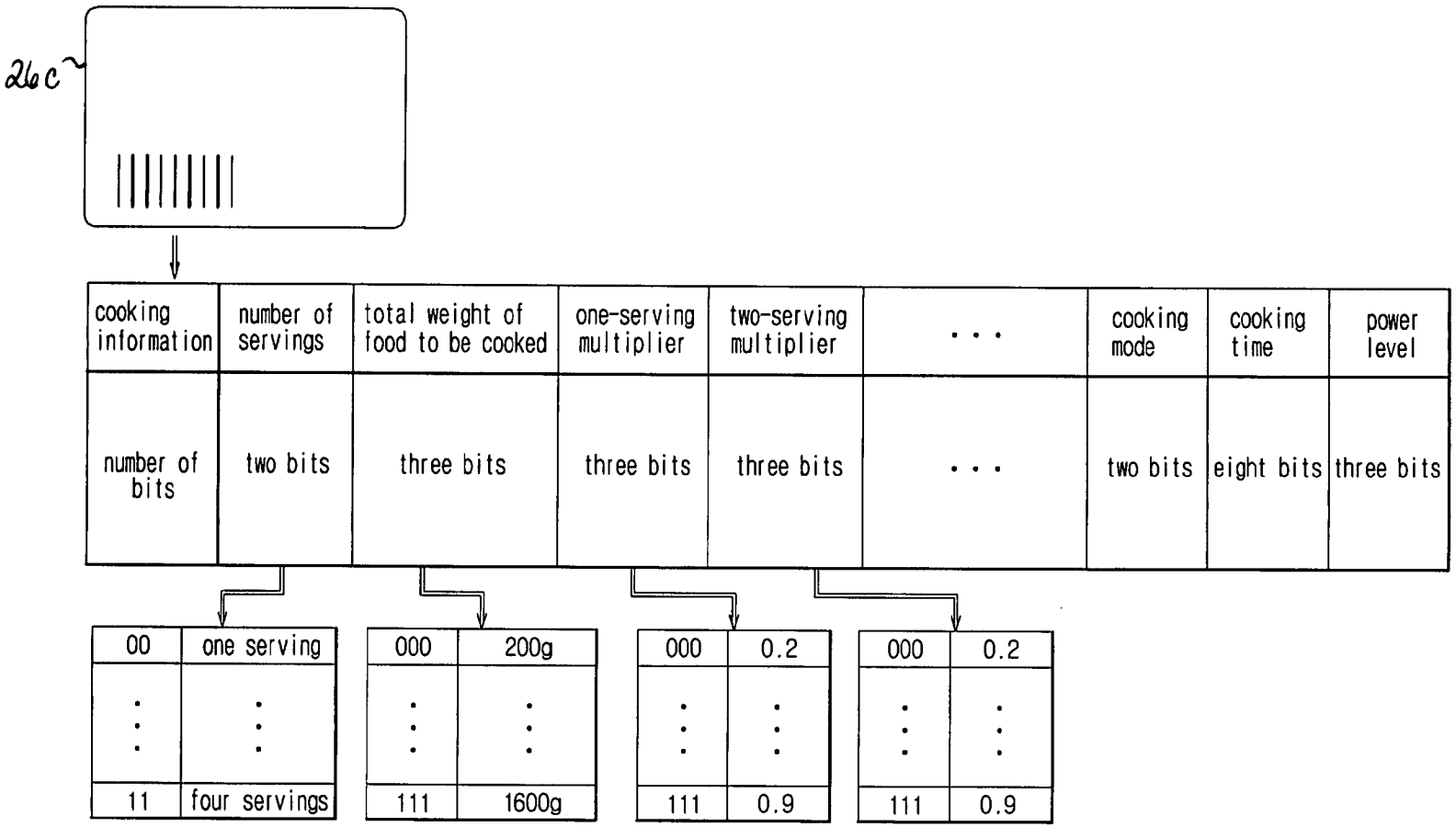
FIG. 9 is a view illustrating cooking information stored in a bar code used in a fourth embodiment of the present invention.
Figure 10:
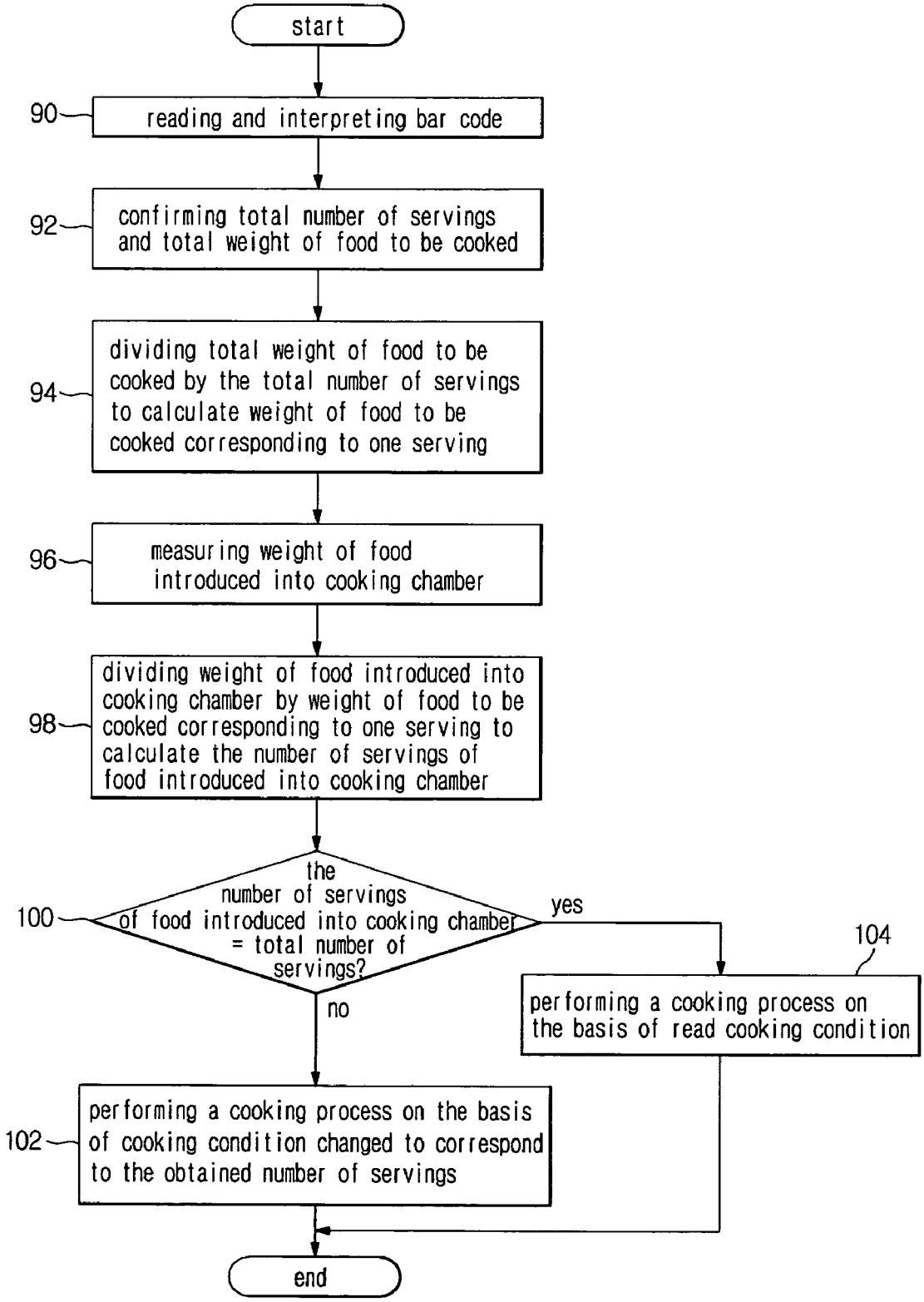
FIG. 10 is a flowchart illustrating an operation of the microwave oven shown in FIGS. 1 and 2 in accordance with the fourth embodiment of the present invention.

The fourth embodiment of the present invention will now be described with reference to FIGS. 9 and 10. As is shown in FIG. 9, a bar code 26*c* used in the fourth embodiment stores the total weight of the food same as the bar code 26*b* in FIG. 7, and the cooking time is set to appropriately cook the entirety of food to be cooked. The additional cooking information of FIG. 9 is identical to that of FIG. 3, the description of which will not be given accordingly.

The operation of the fourth embodiment of the present invention will now be described with reference to FIG. 10. Operations 90 to 98 of FIG. 10 are identical to Operations 70 to 78 of FIG. 8, the description of which will not be given accordingly. Also, Operations 100 to 102 of FIG. 10 are identical to Operations 58 to 62 of FIG. 6, the description of which will not be given accordingly.

As apparent from the above description, the present invention provides a cooking apparatus and a cooking method capable of automatically recognizing the number of servings of food introduced into a cooking chamber. Consequently, the present invention has the effect of optimally cooking the food on the basis of the amount of the food to be cooked.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A cooking method for performing a cooking process using a bar code, the method comprising:

reading a bar code storing a reference weight of food to be cooked and a cooking condition based on the reference weight;

measuring a weight of food introduced into a cooking chamber;

calculating a number of servings of the food introduced into the cooking chamber by dividing the weight of the food introduced into the cooking chamber by the reference weight of the food; and changing the cooking condition to correspond to the number of servings of the food introduced into the cooking chamber, when the number of servings of the food introduced into the cooking chamber is greater than a number of servings corresponding to the reference weight of the food to be cooked, to thereby set a final cooking condition corresponding to the changed cooking condition.

2. The method according to claim 1, further comprising determining the final cooking condition by multiplying a serving multiplier and a cooking condition based on the reference weight of the food, wherein the reference weight is the weight of one serving, and the serving multiplier determines a value by which the cooking condition for one serving is to be multiplied when multiple servings are to be cooked.

3. The method according to claim 2, wherein the cooking condition is one of a cooking time, a temperature of the cooking chamber, or a power level.

4. The method according to claim 1, wherein the weight of the food introduced into the cooking chamber is measured by a weight sensor disposed in the cooking chamber.

5. A cooking method for performing a cooking process using a bar code, the method comprising:

reading a bar code storing a reference weight of a food to be cooked and a cooking condition based on an entire food package to be cooked;

measuring a weight of the food introduced into a cooking chamber;

calculating the number of servings of the food introduced into the cooking chamber by dividing the weight of the food introduced into the cooking chamber by the reference weight of the food; and changing the cooking condition to correspond to the number of servings of the food introduced into the cooking chamber, when the number of servings of the food introduced into the cooking chamber is less than a number of servings corresponding to the entire food package, to thereby set a final cooking condition corresponding to the changed cooking condition.

6. The method according to claim 5, further comprising determining the final cooking condition by multiplying a serving multiplier and a cooking condition based on the entire food package, wherein the serving multiplier determines a value by which the cooking condition for the entire food package is multiplied when less than the entire food package is to be cooked.

7. The method according to claim 6, wherein the cooking condition is one of a cooking time, a temperature of the cooking chamber, or a power level.

8. The method according to claim 5, wherein the weight of the food introduced into the cooking chamber is measured by a weight sensor disposed in the cooking chamber.

9. The method according to claim 5, wherein the reference weight is the weight of one serving.

10. A cooking method for performing a cooking process using a bar code, the method comprising:

reading a bar code storing a total weight and a total number of servings of a food package to be cooked and a cooking condition based on a reference weight;

calculating the reference weight of the food to be cooked by using the total weight and the total number of servings of the food to be cooked;

measuring the weight of the food introduced into a cooking chamber;

calculating a number of servings of the food introduced into the cooking chamber by dividing the weight of the food introduced into the cooking chamber by the reference weight of the food; and changing the cooking condition to correspond to the number of servings of the food introduced into the cooking chamber, when the number of servings of the food introduced into the cooking chamber is greater than a number of servings corresponding to the reference weight of the food, to thereby set a final cooking condition corresponding to the changed cooking condition.

11. The method according to claim 10, further comprising calculating the final cooking condition by multiplying a serving multiplier and a cooking condition based on the reference weight, wherein the reference weight is the weight of one serving, and the serving multiplier dictates the value by which the cooking condition for one serving is multiplied.

12. The method according to claim 11, wherein the cooking condition is one of a cooking time, a temperature of the cooking chamber, or a power level.

13. The method according to claim 10, wherein the weight of the food introduced into the cooking chamber is measured by a weight sensor disposed in the cooking chamber.

14. A cooking method for performing a cooking process using a bar code, the method comprising:

reading a bar code storing a total weight and a total number of servings of a food package to be cooked and a cooking condition based on the total weight;

calculating a reference weight of the food to be cooked by using the total weight and the total number of servings of the food to be cooked;

sensing the weight of the food introduced into a cooking chamber;

calculating a number of servings of the food introduced into the cooking chamber by dividing the weight of the food introduced into the cooking chamber by the reference weight of the food; and changing the cooking condition to correspond to the number of servings of the food introduced into the cooking chamber, when the number of servings of the food introduced into the cooking chamber is less than a number of servings corresponding to the total weight of the food, to thereby set a final cooking condition corresponding to the changed cooking condition.

15. The method according to claim 14, further comprising determining the final cooking condition by multiplying a serving multiplier and the cooking condition based on the total weight of the food to be cooked, wherein the serving multiplier determines a value by which the cooking condition for total number of servings is to be multiplied when less than the total number of servings is to be cooked.

16. The method according to claim 15, wherein the cooking condition is one of a cooking time, a temperature of the cooking chamber, or a power level.

17. The method according to claim 14, wherein the weight of the food introduced into the cooking chamber is measured by a weight sensor disposed in the cooking chamber.

18. A cooking method for performing a cooking process using a bar code, the method comprising:

reading a bar code storing a reference cooking amount of a food to be cooked and a cooking condition based on the reference cooking amount;

sensing an amount of the food introduced into a cooking chamber;

calculating a number of servings of the amount of food sensed by dividing the amount of food sensed by the reference cooking amount; and changing the cooking condition to correspond to the number of servings calculated, when the amount of the food introduced into the cooking chamber is different from the reference cooking amount.

19. The method according to claim 18, wherein the reference cooking amount is one serving, and the sensed amount of the food introduced into the cooking chamber is multiple servings.

20. The method according to claim 19, wherein the bar code further stores a serving multiplier corresponding to the number of servings to be cooked, and the changing a cooking condition further comprises calculating an equation expressed by multiplying a cooking condition based on the reference cooking amount and the serving multiplier corresponding the the number of servings to be cooked.

21. A cooking apparatus comprising:

a bar code reader to read a bar code storing a reference cooking amount of a food to be cooked and a cooking condition based on the reference cooking amount;

a cooking amount sensing unit to sense the amount of the food introduced into a cooking chamber; and a control unit to calculate a number of servings of the amount of food sensed by dividing the amount of food sensed by the reference cooking amount and to change the cooking condition to correspond to the number of servings calculated, when the amount of the food sensed is different from the reference cooking amount, and to perform a controlling operation to carry out a cooking process based upon the changed cooking condition.

22. The apparatus according to claim 21, wherein the reference cooking amount is one serving, and the sensed amount of the food introduced into the cooking chamber is multiple servings.

23. The apparatus according to claim 21, wherein the cooking amount sensing unit is a weight sensor to sense the weight of the food introduced into the cooking chamber.

* * * * *